US007738805B2

(12) United States Patent
Lofthus et al.

(10) Patent No.: US 7,738,805 B2
(45) Date of Patent: Jun. 15, 2010

(54) XEROGRAPHY METHODS AND SYSTEMS EMPLOYING ADDRESSABLE FUSING OF UNFUSED TONER IMAGE

(75) Inventors: Robert M. Lofthus, Webster, NY (US); Kristine A. German, Webster, NY (US); Donald M. Bott, Rochester, NY (US); John R. Andrews, Fairport, NY (US); David K. Biegelsen, Portola Valley, CA (US); Armin R. Volkel, Mountain View, CA (US)

(73) Assignees: Palo Alto Research Center Incorporated, Palo Alto, CA (US); Xerox Corporation, Norwalk, CT (US)

( * ) Notice: Subject to any disclaimer, the term of this patent is extended or adjusted under 35 U.S.C. 154(b) by 0 days.

(21) Appl. No.: 12/035,945

(22) Filed: Feb. 22, 2008

(65) Prior Publication Data

US 2008/0152374 A1 Jun. 26, 2008

Related U.S. Application Data

(63) Continuation of application No. 11/000,168, filed on Nov. 30, 2004, now Pat. No. 7,440,722.

(51) Int. Cl.
*G03G 15/20* (2006.01)

(52) U.S. Cl. ..... 399/69

(58) Field of Classification Search ..... 399/69; 347/211, 129, 101, 212
See application file for complete search history.

(56) References Cited

U.S. PATENT DOCUMENTS 4,972,206 A * 11/1990 Matoushek ..... 347/212
5,241,155 A 8/1993 Koh et al.
5,402,220 A * 3/1995 Tanaka et al. ..... 399/68
5,436,710 A 7/1995 Uchiyama
5,436,712 A 7/1995 Wayman et al.
5,459,561 A 10/1995 Ingram
5,519,426 A * 5/1996 Lukis et al. ..... 347/211
5,678,133 A 10/1997 Siegel
6,430,381 B1 8/2002 Kopp
6,433,807 B1 8/2002 Francis et al.
6,466,750 B2 10/2002 McIntyre
6,494,629 B2 12/2002 Hayashi et al.
6,650,863 B2 11/2003 Fuma (Continued)

FOREIGN PATENT DOCUMENTS

JP 05182748 A * 7/1993

*Primary Examiner*—Quana M Grainger
(74) *Attorney, Agent, or Firm*—Marger Johnson & McCollom, P.C.

(57) ABSTRACT

Methods and apparatus for performing addressable fusing and/or heating of a substrate undergoing xerographic processing are disclosed. The apparatus includes a fuser having an array of addressable heating elements in radiative communication with a substrate through a fuser roll or fuser belt. The array of addressable heating elements is operated to selectively heat portions of the substrate to achieve a desired effect on the substrate, such as changing its surface finish, or fusing unfused toner to the substrate. In the case of toner fusing, the array is operated such that substantially only an area covered by the unfused toner is heated. This eliminates the need for blanket fusing, and generally provides for greater flexibility in xerographically processing substrates. Apparatus and methods for performing two-sided selective fusing and/or heating are also disclosed.

18 Claims, 13 Drawing Sheets

U.S. PATENT DOCUMENTS 6,661,993 B2 12/2003 Bartscher et al.
7,141,761 B1 * 11/2006 Dirubio et al. ..... 219/216
2003/0086735 A1 5/2003 Payne et al.
2004/0183880 A1 * 9/2004 Kito ..... 347/101
2005/0158087 A1 7/2005 Jones et al.
2006/0050133 A1 * 3/2006 Kokubo ..... 347/129

* cited by examiner

XEROGRAPHY METHODS AND SYSTEMS EMPLOYING ADDRESSABLE FUSING OF UNFUSED TONER IMAGE

This application is a continuation of, and claims priority to, U.S. application Ser. No. 11/000,168 filed Nov. 30, 2004.

FIELD OF THE INVENTION

The field of the invention relates generally to xerography, and in particular relates to addressable fusing and heating apparatus and methods.

BACKGROUND OF THE INVENTION

In xerography (also known as electrophotography, electrostatographic printing, and colloquially as "photocopying" and "laser printing"), an important process step is known as "fusing." In the fusing step, a dry marking material, such as toner, is placed in imagewise fashion on an imaging substrate, such as a sheet of paper. The toner is then subjected to heat and/or pressure in order to melt or otherwise fuse the toner permanently on the substrate. In this way, durable, non-smudging images are rendered on the substrates.

Currently, the most common type of fusing apparatus ("fuser") used in commercial xerographic printers includes two rollers, one typically called a "fuser roll," and the other a "pressure roll." The two rolls are arranged adjacent to one another and in contact, thereby forming a nip for the passage of the substrate therethrough. Typically, the fuser roll is hollow and further includes one or more heating elements in its interior. The heating elements are adapted to radiate heat in response to a current being passed therethrough. The heat from the heating elements passes through the surface of the fuser roll, which in turn contacts the side of the substrate having the image to be fused. The combination of heat and pressure is applied to the entire page, thereby successfully fusing the image.

Unfortunately, present-day fusers tend to be one of the most expensive subsystems within a xerographic printer, and can often suffer from reliability issues. Accordingly, alternative approaches for fusers have been developed. For example, U.S. Pat. No. 5,459,561 to Ingram, entitled "Method and apparatus for fusing toner into a printed medium" (hereinafter, "the '561 patent") discloses a method for fusing toner into a printed medium by projecting a high-energy laser beam onto a toner image using an optical scanner. The laser radiation serves to heat the developed toner image on the printed medium. The high-energy laser beam is synchronized with a low-energy laser beam, which is used to develop the latent image on the photoconductive drum or belt. Unfortunately, the approach of the '561 patent is rather complex and expensive, and is not particularly efficient.

Other approaches for fusing are set forth in U.S. Pat. No. 5,436,710 to Uchiyama, entitled "Fixing device with condensed LED light" (hereinafter, the '710 patent). The '710 patent discloses a fixing device for fixing toner images onto a sheet, wherein the device includes a light-emitting diode (LED) array and a cylindrical lens. The cylindrical lens is arranged to condense the light from the LED array onto the surface of the sheet, thereby fixing the toner to the sheet. The various fusing approaches set forth in the '710 patent all involve heating the entire sheet by uniform activation of the elements in the LED array. Thus, the approaches set for the in the '710 patent are not significantly different from other prior art methods in that they involve fusing an entire sheet, regardless of the toner image formed thereon.

SUMMARY OF THE INVENTION

An aspect of the invention is a fuser apparatus for selectively heating the surface of a substrate. The apparatus includes an array of addressable heating elements in radiative communication with the substrate. The apparatus further includes a programmable driver operably coupled to the array of heating elements. The driver is adapted to selectively activate the heating elements to selectively heat portions of the substrate surface as the substrate moves past the array.

Another aspect of the invention is a printer apparatus for forming a fused image onto a substrate having a surface. The apparatus includes a marking engine adapted to form an unfused toner image on the surface. The apparatus also includes a fuser having a first array of addressable heating elements and arranged adjacent the substrate surface. The fuser is adapted to receive the substrate and heat substantially only that area of the surface covered by the unfused toner image. This is accomplished by selectively activating the array addressable heating elements as the substrate moves past the first array.

Another aspect of the invention is a method of fusing toner to a substrate. The method includes forming an unfused toner image on the substrate, recording the unfused toner image, and then selectively heating substantially only that portion of the substrate covered by the unfused toner image so as to fuse the unfused toner image, based on the recorded unfused toner image.

A further aspect of the invention is a method of xerographically processing a substrate. The method includes providing a fuser having an array of addressable heating elements and passing a substrate through the fuser such that a surface of the substrate is in radiative communication with the addressable heating elements. The method also includes selectively heating portions of the substrate surface as the substrate passes by the addressable elements. In one embodiment, the substrate surface includes an unfused toner image, and the selective heating is substantially limited to that substrate surface area covered by the unfused toner image in order to fuse the toner image to the substrate.

Figure 1:
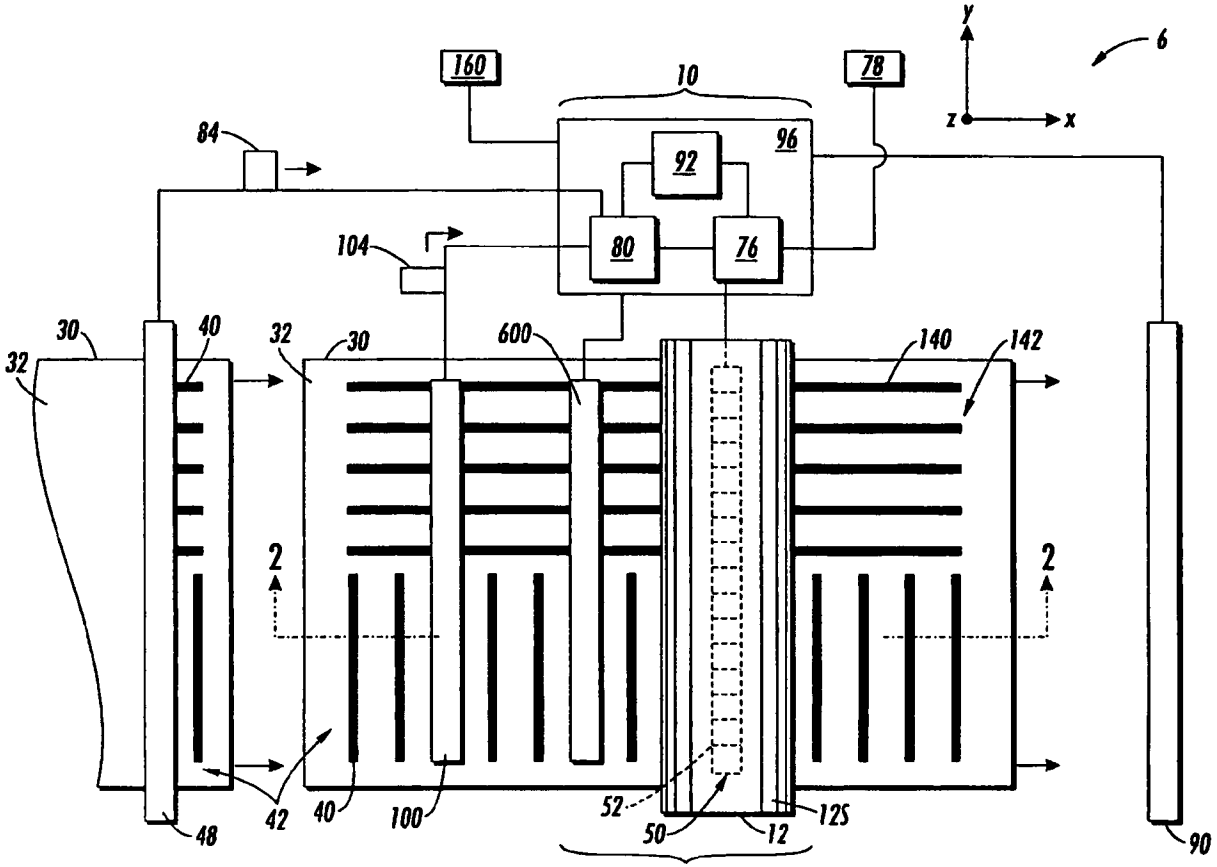
FIG. 1 is a plan view of an example embodiment of a xerographic printing apparatus ("printer") that includes an example embodiment of a fuser apparatus, showing a substrate in the process of being fused by the fuser, and showing the array of addressable heating elements in cut-away view through the fuser roll.

The various elements depicted in the drawings are merely representational and are not necessarily drawn to scale. Certain sections thereof may be exaggerated, while others may be minimized. The drawings are intended to illustrate various embodiments of the apparatus and methods set forth herein that can be understood and appropriately carried out by those of ordinary skill in the art.

DETAILED DESCRIPTION OF THE INVENTION

The apparatus and methods are first described in connection with a general example embodiment. Other specific example embodiments are then set forth. As will be evident from the description below, reduced warm-up time, lower power consumption, the reduction or elimination of sheet warpage, and greater system process latitude are just some of the advantages of the addressable fuser apparatus and methods disclosed herein.

In the description below, the phrase "unfused toner image" is used herein broadly to include not only a select arrangement of toner that is not permanently adhered to a substrate, but also to include partially fixed toner images, as well as the presence of some previously fixed toner, such as in the case of color overprinting.

Generalized Addressable Fuser Apparatus

Figure 2:
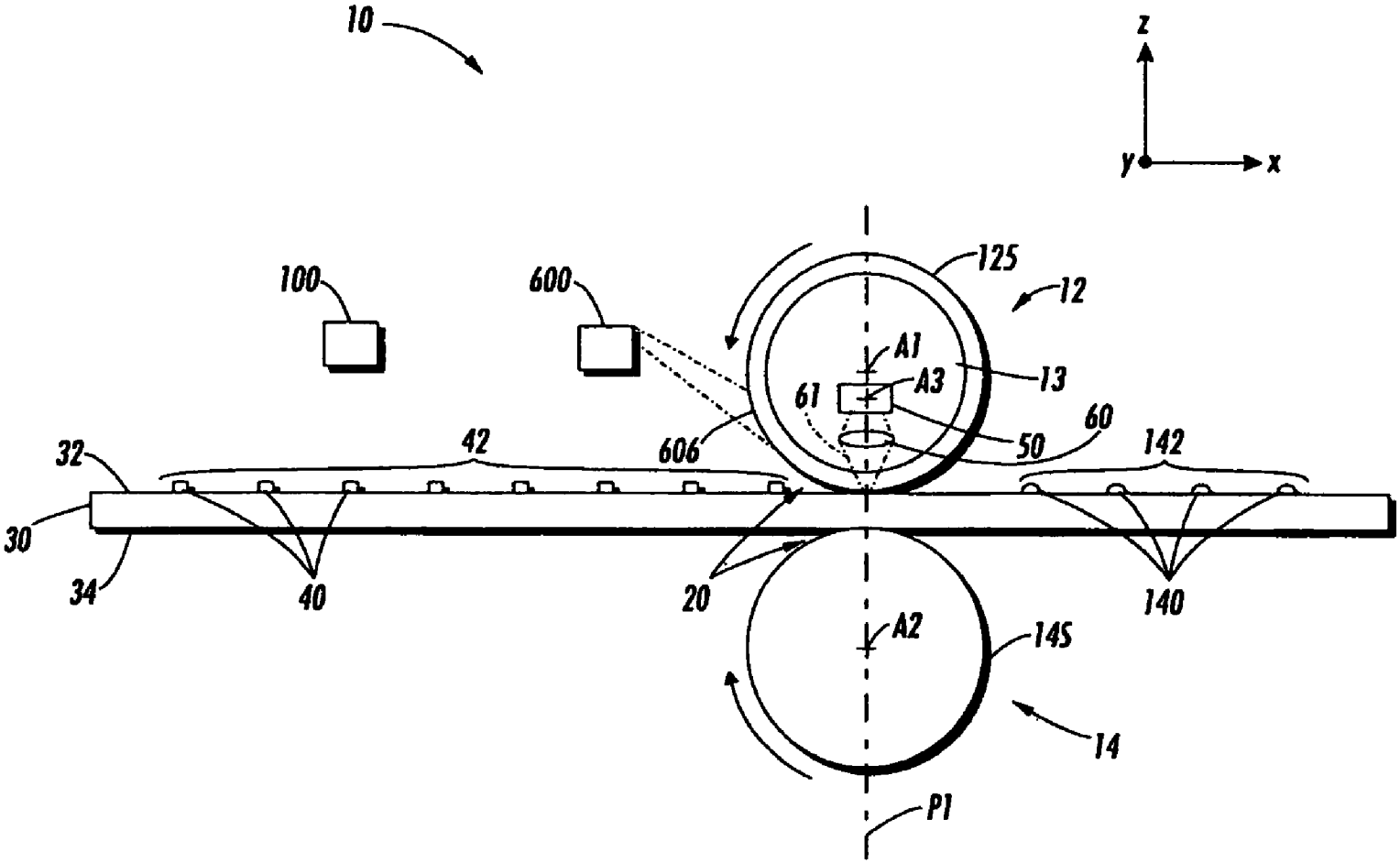
FIG. 2 is a close-up cross-sectional view of the fuser of the printer of FIG. 1, as taken along the line 2-2 in FIG. 1.

FIG. 1 is a plan view of an example embodiment of a xerographic printing apparatus (hereinafter, "printer") 6 that includes a fuser apparatus ("fuser") 10. FIG. 2 is a close-up cross-sectional view of fuser 10 of printer 6 taken along the line 2-2 of FIG. 1. A coordinate system with X-Y-Z axes is shown in FIGS. 1 and 2 for the sake of reference.

With reference to FIGS. 1 and 2, fuser 10 includes a hollow cylindrical fuser roll 12 with an outer surface 12S, a long axis A1 and an interior 13. Fuser 10 also includes an opposing cylindrical pressure roll 14 with an outer surface 14S and a long axis A2. Pressure roll 14 is preferably arranged such that long axis A2 is parallel to and coplanar with long axis A1 (axes A1 and A2 are shown as both aligned in the Y-direction and residing in a common plane P1). In an example embodiment, fuser roll 12 is made of IR-transmitting glass, such as fused quartz or a heat-resistant borosilicate glass (e.g., PYREX, a trademark of Corning, Inc., Corning, N.Y.).

Fuser roll 12 and pressure roll 14 are in pressure contact at a point on their respective outer surfaces 12S and 14S, thereby forming a nip 20. Fuser roll 12 and pressure roll 14 are rotatably driven about their respective axes in the directions indicated by the respective arrows, via respective motors or other drive sources or means (not shown).

A flat substrate (e.g., a sheet of paper) 30 having a planar upper surface 32 and an opposing planar lower surface 34 is provided to fuser 10 at nip 20. Upper surface 32 includes thereon unfused toner 40 that collectively forms an unfused toner image 42. Unfused toner image 42 is formed upstream of fuser 10 at a marking engine 48 using conventional xerographic processes (e.g., a tandem color marking engine). Unfused toner image 42 may be a black and white image, a color image, a magnetic ink character recognition (MICR) image, a custom color image, or the like. The fusing of toner image 42 onto substrate 30 using fuser 10 of printer 6 is discussed in greater detail below.

With continuing reference to FIGS. 1 and 2, fuser 10 further includes an N×M array 50 of addressable heating elements 52, wherein N≧1 and M≧1. In an example embodiment, array 50 is a 1×M linear array, as show and as discussed by way of example in the description below for the sake of illustration. Array 50 has an axis A3 in the Y-direction, and in an example embodiment is disposed and supported within interior 13 of fuser roll 12, with long axis A3 parallel to and coplanar with axes A1 and A2 (i.e., axis A3 lies in plane P1). Array 50 is arranged so that heating elements 52 are in radiative communication with nip 20, or with substrate upper surface 32 when substrate 30 is passing through the nip.

In example embodiments, array 50 is an LED array (e.g., an LED bar), a vertical-cavity surface-emitting laser (VCSEL) array, a liquid crystal pixel illuminated by a line illuminator or an edge-emitting laser diode array, e.g., such as that associated with a raster output scanner (ROS) configuration. In an example embodiment, heating elements 52 emit radiation at an infrared (IR) wavelength, such as 820 nanometers (nm). In an example embodiment, array 50 includes a relatively coarse distribution of heating elements as compared to the imaging pixel elements (not shown) associated with marking engine 48. Thus, in an example embodiment, array 50 includes on the order of ten heating elements 52 per inch.

Figure 3:
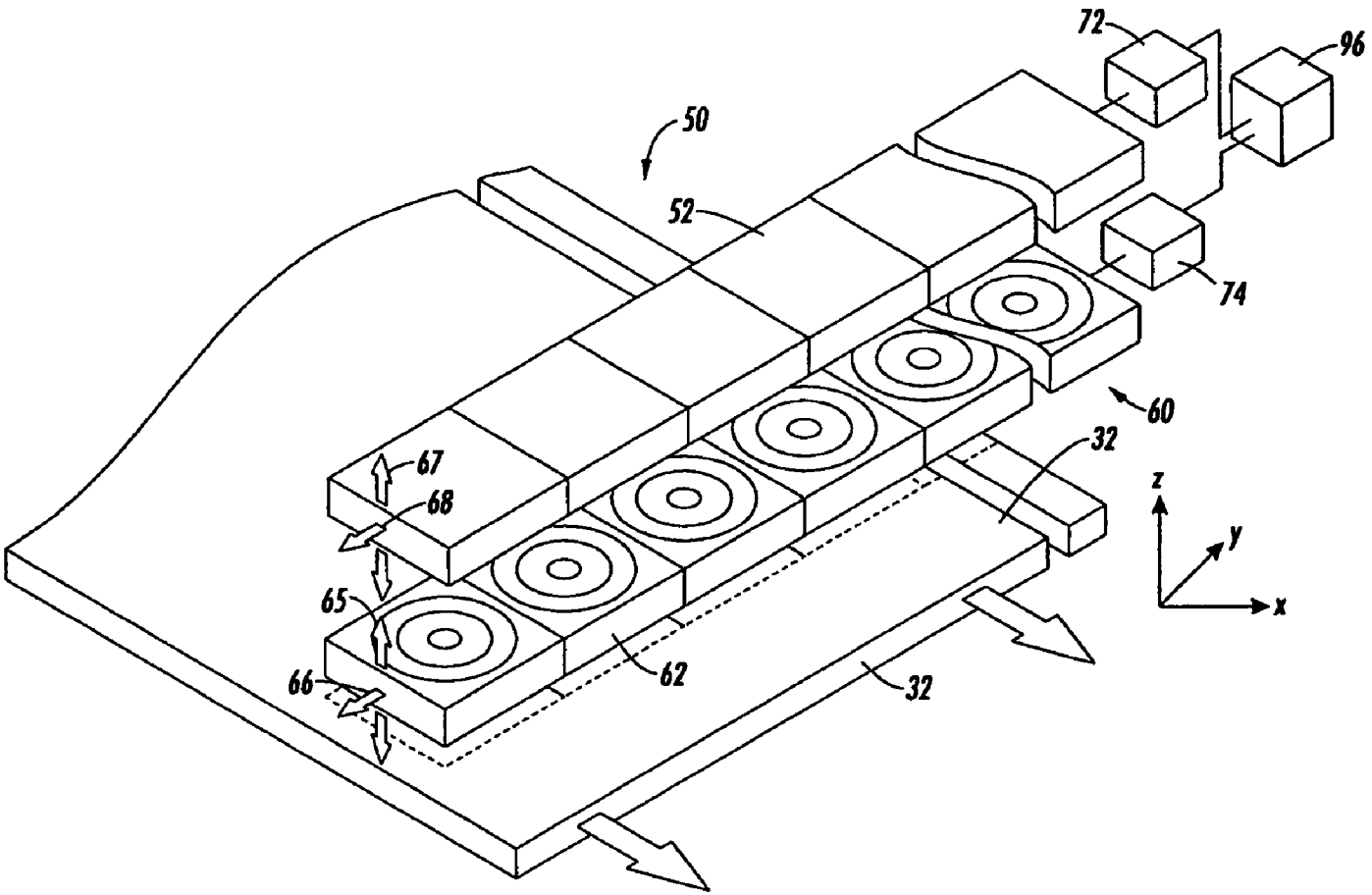
FIG. 3 is a close-up elevational view of the fuser of FIG. 2, illustrating the heating element array in radiative communication with the substrate through the optional focusing lens.

With reference to FIG. 2, in an example embodiment, a focusing lens 60 is optionally arranged adjacent array 50 to focus IR radiation 61 at a focal plane coincident with nip 20. FIG. 3 is a close-up elevational view illustrating the heating element array 50 in radiative communication with substrate surface 32 through a focusing lens 60 in the form of a lenslet array. The lenslet array includes a lenslet 62 for each heating element 52. The lenslets may be, for example, Fresnel or refractive optical elements. In another example embodiment, focusing lens 60 is a cylindrical lens. In another example embodiment, each heating element 52 includes its own individual focusing lens (not shown) fixed thereto, as is customary in certain types of heating elements such as LEDs and laser diodes.

In another example embodiment, focusing lens 60 is translatable in the Z-direction, as indicated in FIG. 3 by arrows 65, to adjust the focus (including intentionally defocusing) the IR radiation 61 at or near nip 20 (i.e., at or near the substrate upper surface 32 when the substrate proceeds through the nip). Also in an example embodiment, focusing lens 60 is laterally movable relative to array 50 in the X and/or Y-directions, as indicated by arrows 66 in FIG. 3, so that the radiation from heating elements 50 can be dithered to improve the uniformity of the illumination at or near nip 20. Likewise, in an example embodiment, array 50 is adapted to be axially and/or laterally movable, as indicated by respective arrows 68 and 67 in FIG. 3, to adjust the focus and/or to dither the illumination of the heating elements.

The movability/adjustability of array 50 and/or focusing lens 60 can serve to mitigate non-uniformity of illumination caused by, for example, inherent variations in heating element output, or variations due to inoperable heating elements. In an example embodiment, array 50 and focusing lens 60 are operably coupled to respective drivers 72 and 74 that are coupled to a controller 96 (introduced and discussed below) and that are adapted to move the array and/or the focusing lens in response to signals from the controller.

With reference again to FIGS. 1 and 2, array 50 is operably (e.g., electrically) coupled to a programmable heating element driver (hereinafter "driver") 76, which in turn is operably (e.g., electrically) coupled to a power source 78. Driver 76 is also operably (e.g., electrically) coupled to an electronic image storage device 80 (e.g., a buffer), which is operatively (e.g., electrically) coupled to marking engine 48. Electronic image storage device 80 is adapted to store electronic (digital) images, such as an electronic image of unfused toner image 42 created by marking engine 48 and embodied in an electronic-image signal 84 (e.g., an electrical signal) provided to the storage device.

With reference to FIG. 1, in an example embodiment xerographic apparatus 6 includes a cleaning unit 90 downstream of fuser 10. Cleaning unit 90 is adapted to remove unfused toner 42 from substrate upper surface 32 after the substrate has passed through fuser 10. Cleaning unit 90 may include, for example, air jets, air knives, a vacuum, electrostatic transfer elements, brushes or the like (not shown).

In an example embodiment, driver 76 and electronic image storage device 80 are part of a single controller 96 that also includes a programmable processor 92. Controller 96 is coupled to marking engine 48 and to cleaning unit 90, and to optional array and lens drivers 72 and 74, and is adapted to coordinate the operation of these and other elements (not shown) in the xerographic apparatus, as described below. In an example embodiment, the coordinated operation of the controller is achieved through a set of operating instructions (e.g., software) programmed into programmable processor 92.

General Method of Operation

With continuing reference to FIGS. 1 and 2, in the operation of xerographic apparatus 10, an electronic image of toner image 42 is captured upstream of the fuser via known techniques associated with the operation of marking engine 48 in creating the toner image. The captured electronic image is embodied in electronic-image signal 84, which is then provided to electronic image storage device 80, where the electronic image is stored. In an example embodiment, information regarding the (X, Y, ⊖) registration of the toner image 42 relative to substrate 30 in the upstream marking process that creates toner image 42 is recorded or is otherwise included in the electronic-image signal 84. In an example embodiment, the electronic image is stored in rasterized format such as is created using a raster output scanner (ROS). In another example embodiment, the electronic image is stored as a bitmap. The electronic image is then provided to controller 96 and driver 76.

Substrate 30 proceeds from marking engine 48 and is then fed into nip 20 of fuser 10. As substrate 30 proceeds through nip 20, in an example embodiment heating elements 52 in array 50 are selectively activated by driver 76 based on the information in electronic image so that substantially only those portions of substrate surface 32 that include unfused toner 40 are heated.

In the selective activation of heating elements 52, it should be noted that the amount of heat provided by each heating element need not be the same for all heating elements. Thus, in an example embodiment, the amount of heat provided by each heating element 52 via the operation of driver 76 varies between the heating elements. The variation can be based on, for example, the nature of unfused toner image 42, variations in the surface finish on substrate surface 32, different toners being present on the substrate surface, or other fusing considerations. On the other hand, there are instances where it may be advantageous for each heating element 52 to provide a fixed amount of heat, i.e., where there is no variation in the amount of heat generated between the different heating elements. Such fixed heating may be preferred, for example, when unfused toner image 42 is relatively uniform in nature. Thus, in an example embodiment, programmable driver 76 is adapted to cause each of the heating elements 52 to generate a fixed amount of heat.

By way of example, consider the toner image 42 shown on substrate surface 32 in FIG. 1. Toner image 42 therein consists of thin horizontal lines (in the Y-direction) on the "right half" of the substrate and thin vertical lines (in the X-direction) on the "left half" of the substrate. For this example toner image, as substrate 30 passes through fuser 10, addressable elements 52 on the left half of array 50 that line up with (i.e., have the same Y-coordinate as) a vertical line are activated, while those elements not lined up with a vertical line remain inactive. On the other hand, the addressable elements 52 on the right half of array 50 under which at least a portion of the horizontal lines will pass are activated each time a horizontal line passes beneath the array, and otherwise remain inactive while the space between lines passes beneath this portion of the array. In this manner, substantially only unfused toner 40 is illuminated as the substrate passes through the fuser. Which heating elements are activated in the fusing process is governed by the unfused toner image formed upstream. This allows for pattern-dependent image fusing, rather than blanket fusing of the substrate.

As substrate 30 passes through and exits nip 20, the action of the heat and pressure of fuser roll 12 and pressure roll 14 fixes previously unfused toner 40 to substrate surface 32, thereby forming thereon fixed toner 140 and a corresponding fixed toner image 142. This is accomplished by only heating an area of substrate surface 32 that is minimally larger than that defined by the area covered by unfused toner 40.

With continuing reference to FIGS. 1 and 2, in an example embodiment, the (X, Y, ⊖) registration of substrate 30 as it enters nip 20 at fuser 10 is based on the registration as established during the marking process, in combination with assuming the substrate registration upon entering fuser 12 is within the registration tolerance. In another example embodiment, the substrate registration is determined by measuring the semi-static image-to-paper registration using a calibration print, as is known in the art.

In another example embodiment, the toner image is sensed directly prior to the substrate entering nip 20. In another example embodiment, a local autocorrelation of toner image 42 (or information relating thereto) with printing data is used to inexpensively determine image properties such as the (X, Y, ⊖) registration and warpage.

In a more robust example embodiment that can measure the dynamic and static registration, the (X, Y, ⊖) registration of substrate 30 as it enters nip 20 is measured and compared to the registration of toner image 42 as formed on substrate surface 32 during the upstream marking process. This is accomplished, for example, by capturing a second electronic image of the toner image via an image sensor 100, such as a digital camera, arranged upstream of fuser 10 and optically coupled to substrate 30 as it passes under the image sensor. Image sensor 100 is operably (e.g., electrically) coupled to driver 76, preferably through electronic image storage device 80, as shown. The second electronic image is embodied in a second electronic-image signal 104 provided from image sensor 100 to storage device 80. The relative (X, Y, ⊖) registrations of the first and second electronic images are then compared (e.g., with the assistance of processor 92) and any offset or warpage is accounted for in the selective activation of addressable heating elements 52.

In an example embodiment, toner image 42 includes cyan, yellow, magenta and black images, and addressable elements 52 are activated so that an area on substrate surface 32 that is at most only minimally larger than that defined by the union of these images is heated.

With reference once again to FIG. 1, after being processed by fuser 10 according to one or more of the example embodiments described above, substrate 30 then passes to cleaning unit 90, which is in operable communication with substrate upper surface 32. Controller 96 directs cleaning unit 90 to remove unfused toner from substrate upper surface 32 (e.g., via blanket clean). By fusing an area of substrate upper surface 32 that is at most only minimally larger than that defined by the unfused toner image 42, any unfused toner remnants (e.g., background streaks, bands and flecks) falling outside of the fused area will be removed from the substrate during cleaning. In the prior art approaches, such remnants would be fused to the substrate and not be removable by the cleaning unit.

Selective Substrate Heating

Certain printing applications call for printing on substrates having different finishes (e.g., matte or gloss). Other applications may call for printing on substrates having different finishes on the same printing surface. Likewise, certain printing applications, such as color printing, require different types of toner, which in turn affects how the fusing step needs to be carried out.

Thus, in another more general example embodiment, addressable elements 52 are activated so that a select portion of substrate surface 32 not necessarily defined solely by toner image 42 is heated. For example, substrate 30 may have a finish on surface 32 that is altered by the select application of heat. Selectively heating portions of such a finish can alter the appearance of the substrate in a desired manner. The selectively heated substrate portions can have any shape that can be programmed into or otherwise provided to driver 76, and is limited only by the resolution of heating elements 52.

In an example embodiment, the amount and distribution of heat provided to substrate surface 32 by addressable heating elements 52 is varied by driver 76 to accommodate the type and quantity of toner and/or the particular finish (or combination of finishes) of substrate surface 32. In an example embodiment, information relating to the type of finish of substrate surface 32 is inputted to controller 96 via an input device (e.g., a key pad) 160 operably coupled thereto. Thus, different surface finishes can be provided to different portions of the substrate or aspects of the type of image to be formed, e.g., a matte finish for pictorials and glossy finish for text, or vice versa. As discussed above, select portions of substrate surface 32 can be heated to achieve a desired effect in the select portion, such as changing a glossy finish to a matte finish, or by forming an image in the finish itself through the effect of heating. The resulting gloss image may be used as authenticity verification for a printed object, similarly to a watermark.

In the example embodiment wherein heat is selectively supplied to the substrate to alter the surface finish of the substrate and not necessarily for fusing unfused toner, cleaning unit 96 can also provide for cooling of the substrate, e.g. by applying a vacuum or a stream of cool air that removes heat from the substrate.

Heat Transfer Belt

In certain printing applications, variations in the absorptive properties of the toner and the substrate could lead to undesirable variations in printing quality. In such instances, it would be preferred that the transfer of heat to the substrate not depend on the toner and/or the surface characteristics of the substrate.

Figure 4:
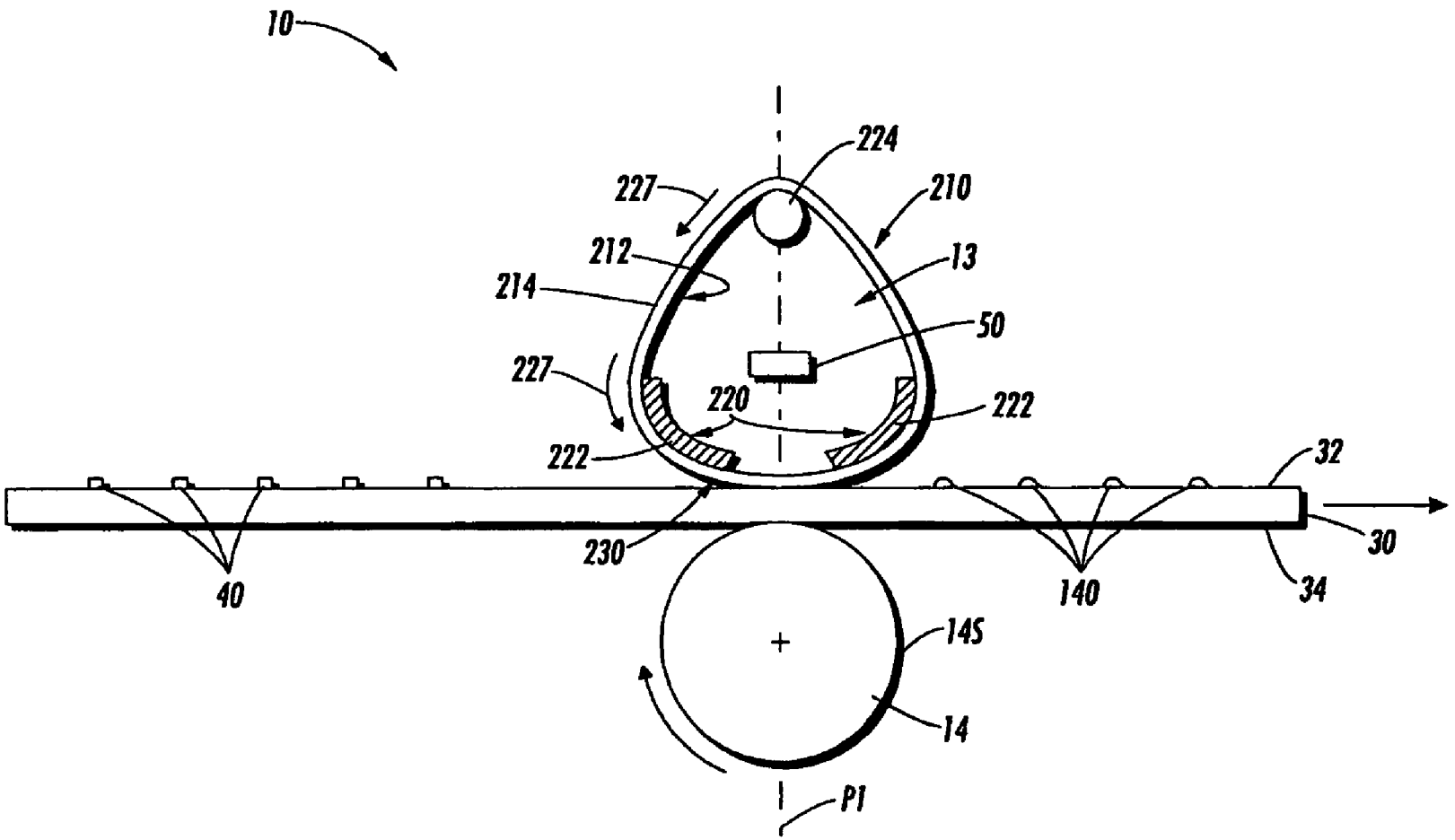
FIG. 4 is a close-up cross-sectional view of an example embodiment of a fuser similar to that shown in the printer of FIG. 2, except that the fuser roll is replaced with a fuser belt adapted to facilitate the transfer of heat from the heating elements to the substrate.

FIG. 4 is a cross-sectional view of an example embodiment of a fuser 10 similar to that shown in printer 6 of FIG. 1, except that fuser roll 12 is replaced with a fuser belt 210 having an inner surface 212 and an outer surface 214. Fuser 10 of FIG. 4 also includes guides 220 arranged adjacent nip 20 and on respective sides of plane P1. Guides 220 have outer surfaces 222. Fuser 10 also includes a roller driver 224 arranged to support and drive fuser belt 210 over guide outer surfaces 222. Array 50 is supported within interior region 13 defined by the fuser belt 210, as supported by outer surfaces 220S and 222S of supporting guides 220 and 222, and roller driver 224. Heating elements 52 of array 50 are in radiative communication with nip 20 between guides 220 and through a portion 230 of fuser belt 210 that is immediately adjacent nip 20 at any given time during the belts rotation (as indicated by arrows 227).

Fuser belt 210 preferably has a low through-sheet thermal conductivity and a low lateral thermal conductivity to facilitate the transfer of heat from the heating elements to substrate upper surface 32 as substrate 30 passes through nip 20. In an example embodiment, fuser belt 210 serves to convert optical energy into heat in portion 230. In an example embodiment, fuser belt 210 is formed from a polymer sheet, such as PET, PEN, polyimide, or like polymer sheets, that are uniformly optically transparent and thermally insulating. Other layers can be added to the sheet as optically absorbing layers, ablatable layers, and strengthening layers.

In another example embodiments where optical radiation (energy) is converted to thermal energy on the inside of the belt, fuser belt 210 is made of a thermally insulating matrix with a dense array of conducting fibers penetrating from one side of the belt to the other. The lateral thermal conductivity can thereby be much lower than the through-belt conductivity.

Figure 5:
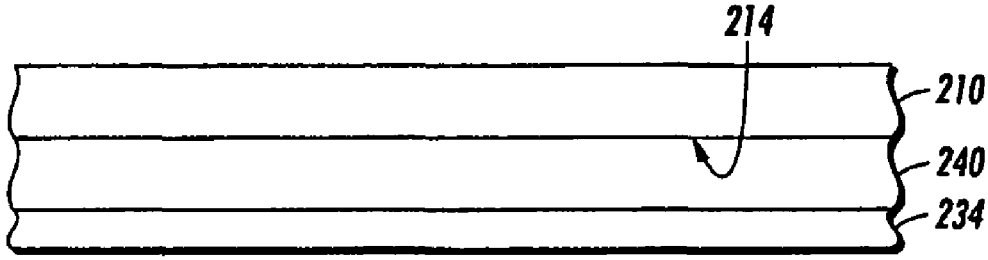
FIG. 5 is a close-up side view of an example embodiment of the fuser belt of FIG. 4, wherein the fuser belts includes an outer release layer as well as one or more intermediate material layers.

FIG. 5 is a close-up side view of an example embodiment of fuser belt 210 of FIG. 4, wherein outer surface 214 of belt 210 is overcoated with one or more material layers. In an example embodiment, belt 210 includes an outer surface release layer 234 formed above outer surface 214 to reduce toner adhesion to the belt. In an example embodiment, one or more interior layers, collectively identified as 240, is/are arrange between outer release layer 234 and fuser belt 210. In an example embodiment, layer 240 is optically absorbing and converts optical radiation at a wavelength emitted by heating elements 52, to thermal energy, which is then communicated to the substrate. In an example embodiment, outer release layer 234 is composed of one or more materials from common release material classes known to those skilled in the art, such as fluoroplastics, e.g., PFA, PTFE, FEP, silicones, and fluoroelastomers.

In an example embodiment, the interior layers may include one or more adhesive layers to strengthen inter-layer bonding, as well as one or more conformable layers composed of silicone or other elastomers. The internal and external coatings may optionally have fillers to control electrical and thermal resistivity.

Disposable Belt

With fuser rolls such as fuser roll 12 of fuser 10 of FIGS. 1 and 2, the outer surface of the roll is typically in contact with each substrate to be processed. Accordingly, the fuser roll outer surface must be cleaned after contacting the substrate surface but prior to making contact with the next substrate surface. Such cleaning typically requires the use of a specially designed mechanical cleaner or chemical agents, such as fuser oil (typically, silicone oils) to avoid adhesion of toner to the fuser roll.

Figure 6:
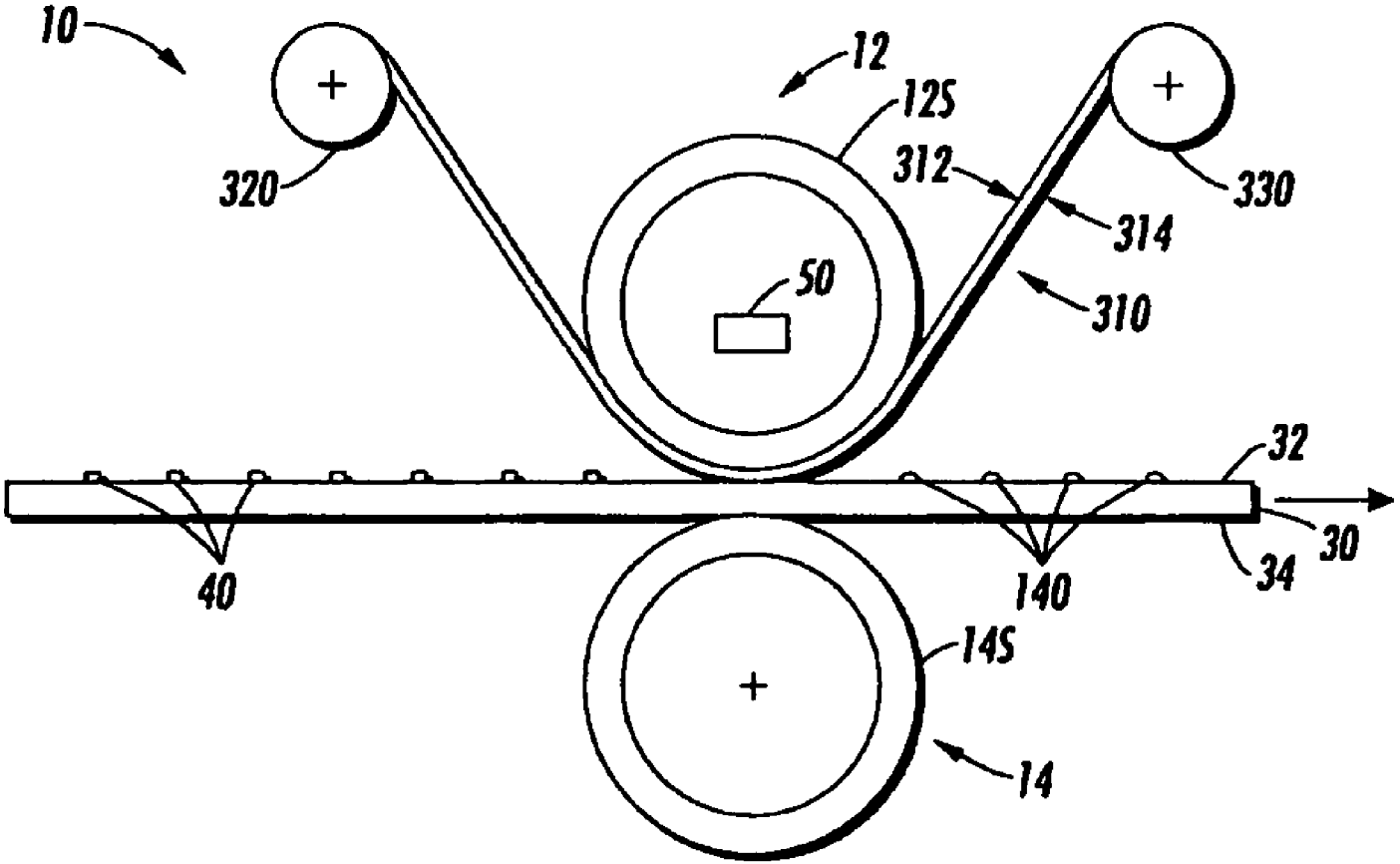
FIG. 6 is a close-up cross-sectional diagram of an example embodiment of a fuser similar to that shown in the printer of FIG. 2, and similar to that of FIG. 4, wherein the fuser employs a disposable fuser belt.

Use of a disposable fuser belt obviates the need to clean fuser roll 12 to maintain consistent printing quality. FIG. 6 is a close-up cross-sectional diagram of a fuser 10 similar to that shown in FIG. 2 as part of printer 6, but additionally including a disposable fuser belt 310 having an inner surface 312 and an outer surface 314. Fuser 10 of FIG. 6 is also shown with a hollow pressure roll 14 that is the same as or similar to hollow fuser roll 12. Such an arrangement makes for a light-weight fuser capable of providing pressure to the substrate from both sides.

Fuser belt 310 is stored on a source roll 320 and is arranged so that inner surface 312 of the fuser belt passes over fuser surface 12S of fuser roll 12 at nip 20. After exiting nip 20, fuser belt 310 is taken up by a take-up roll 330. In an example embodiment, disposable fuser belt 310 is made of or includes a thin sheet of IR-transparent thermally insulating material (e.g., MYLAR, a trademark of DuPont Corporation, Delaware). Disposable fuser belt 310 serves to protect outer surface 12S of fuser roll 12 from wear and increases its useful lifetime. Belt 310 also increases the efficiency of heat generation at the fusing point, thus allowing the fuser to operate with less input power from power supply 76 (FIG. 1).

Figure 7:
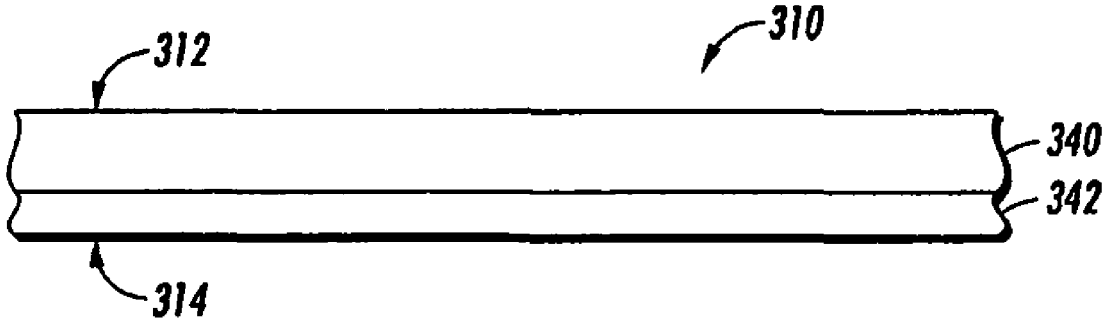
FIG. 7 is a close-up cross-sectional view of an example embodiment of disposable fuser belt of FIG. 6, wherein the fuser belt includes an inner optically transparent and thermally conducting layer and an outer optically absorbing layer.

FIG. 7 is a close-up cross-sectional view of an example embodiment of disposable fuser belt 310, wherein the fuser belt includes an inner layer 340 and an outer layer 342. Inner layer 340 is made of an optically transparent and thermally insulating material, such as a polymer. Example polymers are PET, PEN, polyimide, or the like. Outer layer 324 is a thin optically absorbing layer having an absorption band that includes, or is specifically tuned to an emission wavelength of heating element array 50.

Figure 8:
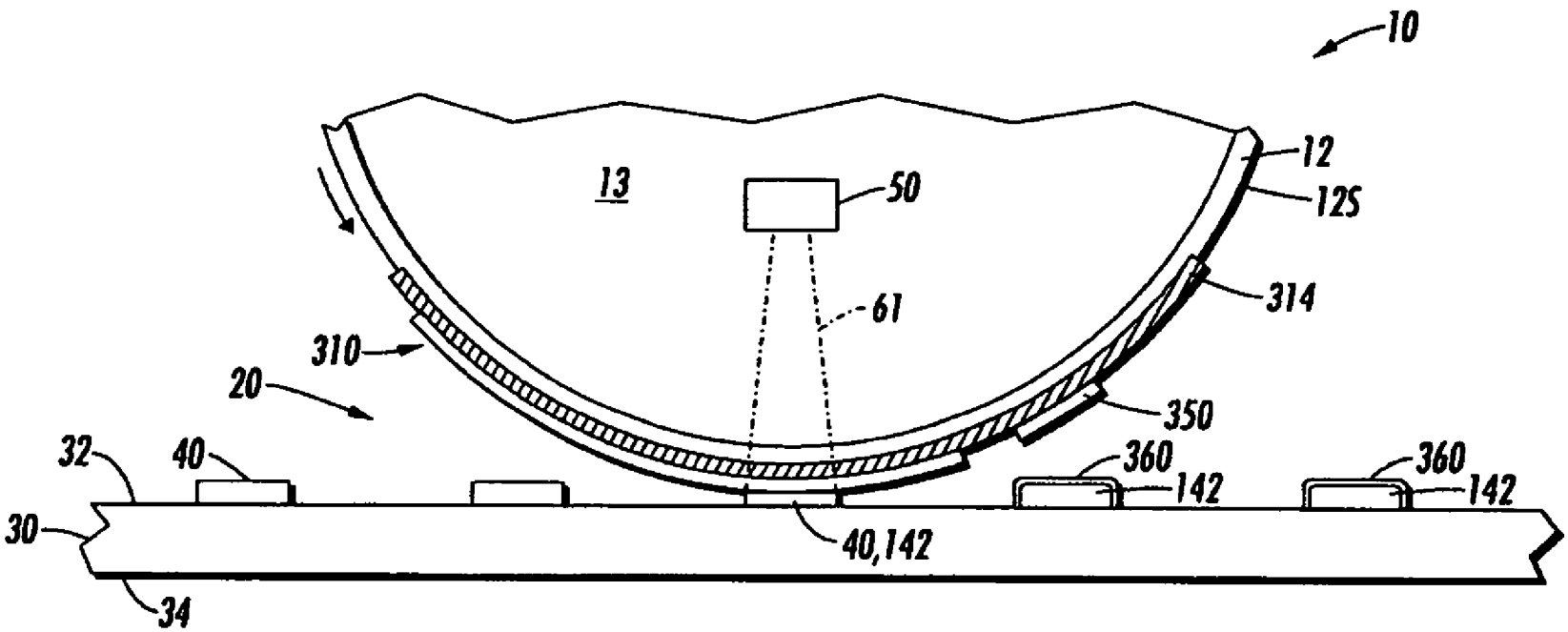
FIG. 8 is a close-up cross-sectional view of an example embodiment of the fuser of FIG. 6, showing the disposable fuser belt with an ablatable coating.

In an example embodiment, disposable fuser belt 310 includes an ablatable coating 350 on outer surface 314. FIG. 8 is a close-up cross-sectional view of fuser 10 of FIG. 6, focusing in on nip 20 and the disposable fuser belt 310 with ablatable coating 350. In operation, as substrate 30 passes through nip 20, unfused toner 40 is fixed to substrate upper surface 32 via the selective application of heat from the addressable heating elements 52, as described above. The heating energy (e.g., IR optical radiation) 61 from addressable elements 52 also serves to ablate the corresponding portion of ablatable coating 350. Ablation mitigates adhesion of toner to the belt 310. The ablated material can also coat the now-fused toner 140 and form a protective layer 360 thereon. Protective layer 360 is used, for example, to improve the reflective properties (gloss) of the fixed toner image 142, and/or to enhance the rheological properties of the molten toner.

Two-Sided Addressable Fusing/Heating

The present invention includes example embodiments wherein addressable fusing or heating is performed on both sides of the substrate being processed. Two such example embodiments are described below with reference to the generalized one-sided addressable fuser 10 discussed above in connection with FIG. 1 and FIG. 2. It will be evident to one skilled in the art that the configurations described below can be used in conjunction with or otherwise implement the disposable fuser belt embodiments described above.

Simultaneous Two-Sided Fusing/Heating

Figure 9:
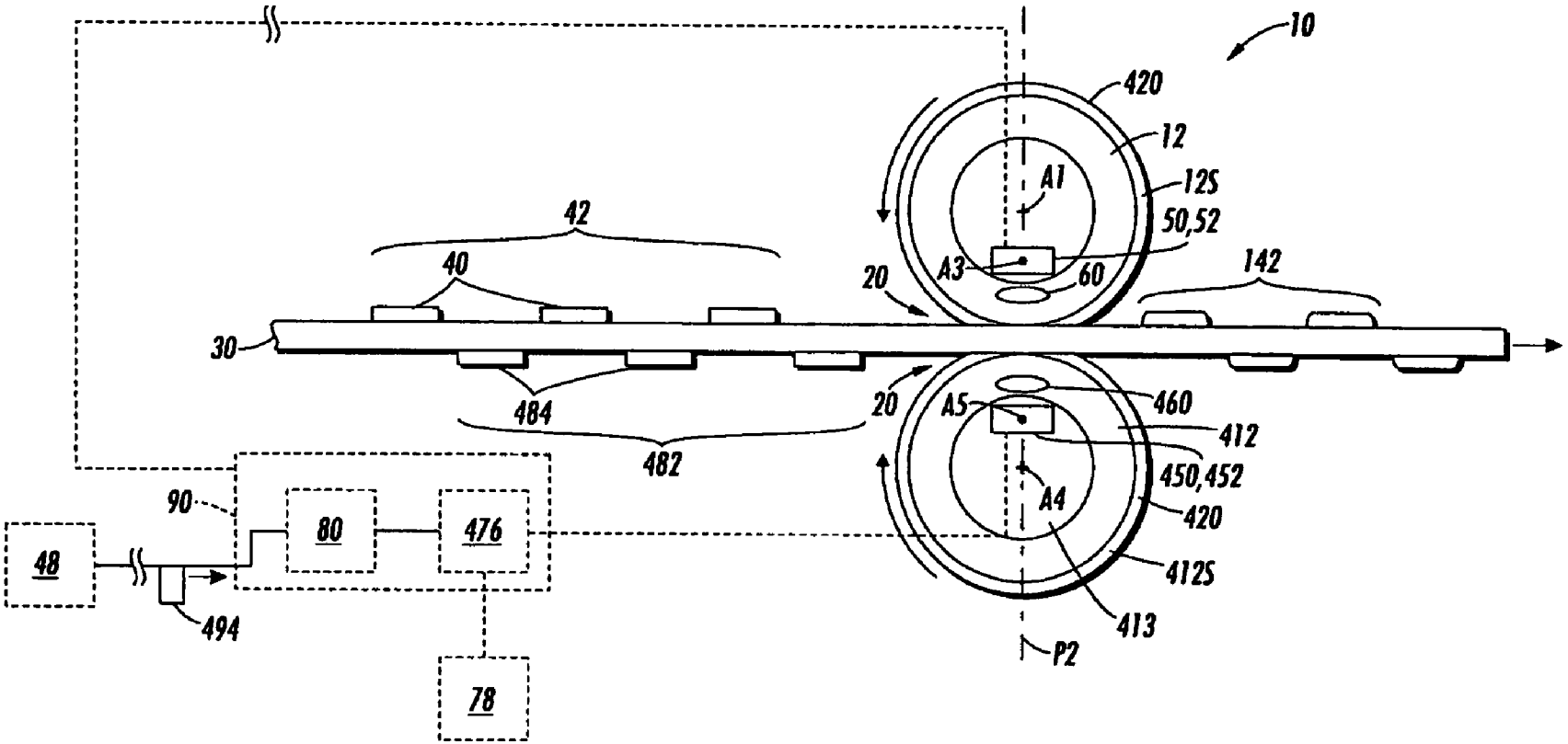
FIG. 9 is a close-up cross-sectional view of an example embodiment of a fuser similar to that shown in the printer of FIG. 2, wherein the fuser includes two opposing fuser rolls and is adapted for simultaneous two-sided addressable fusing.

FIG. 9 is a close-up cross-sectional view of an example embodiment of a fuser 10 similar to that shown in the printer of FIG. 2, but wherein the fuser is adapted for simultaneous two-sided addressable fusing or selective heating.

Fuser 10 of FIG. 9 includes the same elements as that shown in FIGS. 1 and 2, wherein pressure roll 14 is a hollow roller the same as or similar to hollow fuser roll 12. For the sake of discussion and clarity, what was pressure roll 14 in FIG. 2 is referred to in the present example embodiment as fuser roll 412 to emphasize the additional functionality of this element. Fuser roll 412 has an outside surface 412S, in interior region 413, and a long axis A4.

Fuser roll 412 is arranged such that long axis A4 is parallel to and coplanar with (i.e., in a plane P2 with) long axis A1 of fuser roll 12. In an example embodiment, fuser roll 412 is made of glass, such as fused quartz or heat-resistant borosilicate glass, such as PYREX, mentioned above. Fuser rolls 12 and 412 are in pressure contact at their respective outer surfaces 12S and 412S, thereby forming nip 20. Note that each fuser roll serves as the pressure roll for the opposing fuser roll. Fuser rolls 12 and 412 are rotatably driven about their respective axes in the directions indicated by the arrows, via respective motors or other drive sources (not shown). In an example embodiment, fuser rolls 12 and/or 412 are coated with a transparent elastomeric layer 420 atop respective outer surfaces 12S and 412S in order to allow reasonable pressures to exist and/or be controlled across nip 20.

Fuser 10 of FIG. 9 further includes a second M×N array 450 of addressable heating elements 452. In an example embodiment, array 450 is a linear array (1×M) having an axis A5 and is disposed and supported within interior 413 of fuser roll 412 with axis A5 parallel to and coplanar with axis A4 (i.e., in plane P2). Array 450 is arranged so that heating elements 452 are in radiative communication with nip 20, but from the opposite direction as heating elements 52 of array 50. In essence, heating array 450 is the same as or is substantially similar to heating array 50, which is described in detail above in connection with fuser 10 of FIGS. 1 and 2. Like array 50, array 450 may be axially and laterally movable. Likewise, array 450 may also be optically coupled to a corresponding focusing lens 460 identical or similar to focusing lens 60 associated with array 50 as described above and having the same optional movement capability for focusing and/or dithering.

Array 450 is operably (e.g., electrically) coupled to a programmable driver 476, which in turn is operably (e.g., electrically) coupled to power source 78. Driver 476 is also operably (e.g., electrically) coupled to electronic image storage device 80 and to controller 96. In an example embodiment, an electronic image is stored in device 80 that corresponds to a toner image 482 formed from toner 484 on lower surface 34 of substrate 30. Like the electronic image of toner image 42 embodied in electronic image signal 84, the electronic image corresponding to toner image 482 is obtained from marking engine 48 via an electronic-image signal 494.

The operation of fuser 10 of FIG. 9 is essentially the same as described above in connection with fuser 10 of FIGS. 1 and 2, except that the addressable arrays 50 and 450 operate simultaneously and synchronously via controller 96, e.g., to fuse a single toner image, e.g., 42 on upper substrate upper surface 32. In an example embodiment, addressable arrays 50 and 450 operate simultaneously but independently via controller 96 to fuse respective unfused toner images 42 and 482 formed on respective upper and lower surfaces 32 and 34 of substrate 30. In other example embodiments, addressable arrays 50 and 450 operate to selectively heat the same portions or different portions of respective substrate surfaces 32 and 34.

In some instances, the selective application of heat to one side of the substrate can affect the other side of the substrate. Thus, in an example embodiment, addressable arrays 50 and 450 are operated to take such sensitivities into account. For example, suppose that there are two different unfused toner images 42 and 482 formed on respective upper and lower surfaces 32 and 34 of substrate 30. Further, suppose that fusing of one unfused toner image will adversely affect the other at areas where the two unfused toner images overlap. In such a case, corresponding drivers 76 and 476 can be programmed to provide reduced amounts of heat to those areas of the substrate where the unfused toner images overlap. This allows for the total amount of heat applied to such areas from above and below to be below the threshold for causing an adverse affect at the overlap positions. Thus, in general, the selective heating of opposite surfaces of the substrate can be performed in a manner that accounts for the effect that the heat applied to one side of the substrate has on the opposite side. Furthermore, two-sided imagewise heating will generally use less power per side than sequential single-side image fusing.

Sequential Two-Sided Fusing

Figure 10:
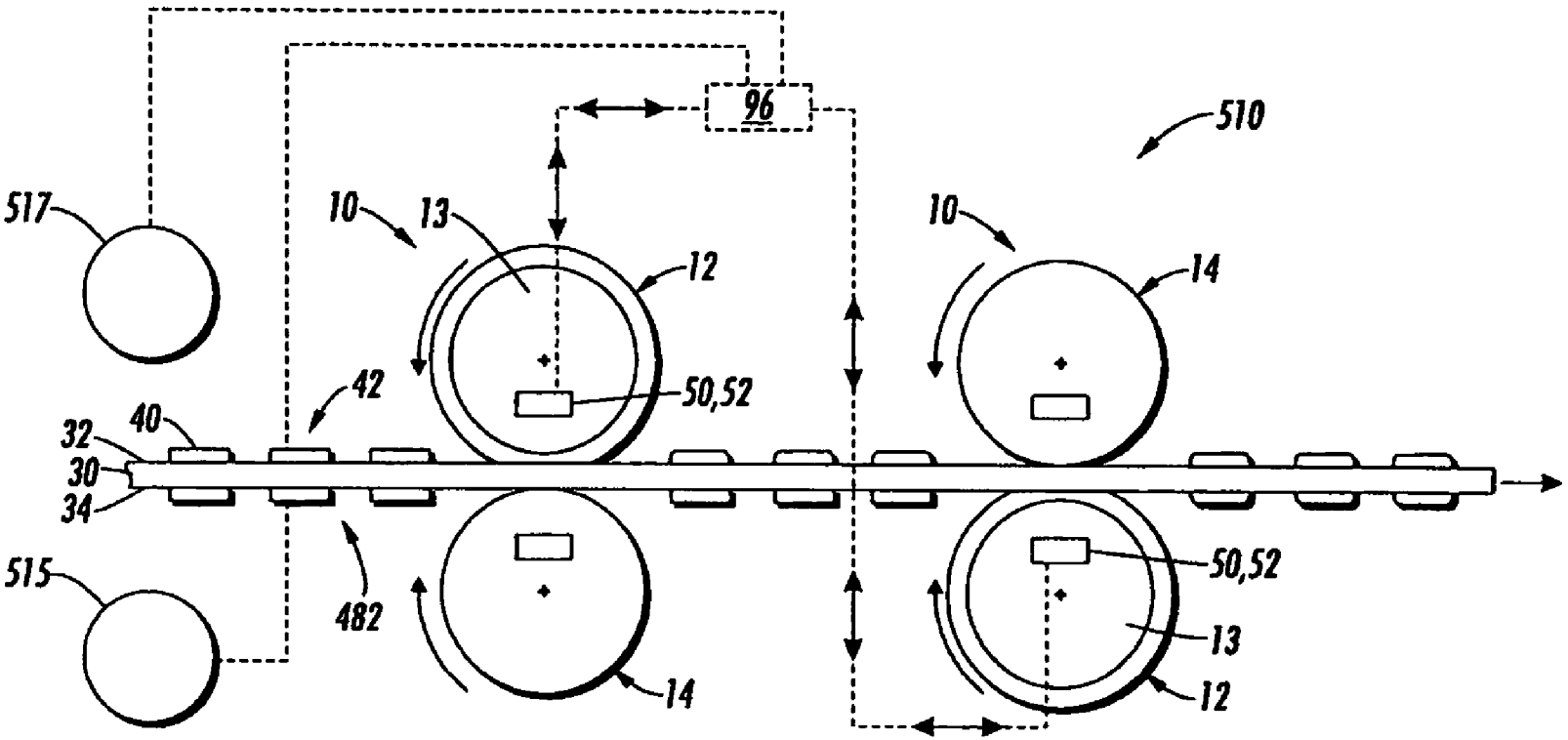
FIG. 10 is a close-up cross-sectional view of an example embodiment of a fuser similar to the shown in FIG. 9, wherein the printer includes two off-set fusers adapted to perform sequential two-sided fusing.

FIG. 10 is a close-up cross-sectional view of an example embodiment of a fuser 510 similar to fuser 10 of FIG. 9, but that is adapted to perform sequential two-sided fusing. Fuser 510 of FIG. 10 includes a first fuser 10, along with a second fuser 10 arranged downstream thereof and upside-down—that is, with pressure roll 14 and fuser roll 12 arranged on opposite sides of the substrate as compared to the first fuser. This arrangement allows for sequential processing of substrate upper surface 32 and then substrate lower surface 34. Note that the two sets of rolls can be reversed so that substrate lower surface 34 is processed before substrate upper surface 32. The two fusers 10 are each operably coupled.

In certain circumstances, it may prove desirable to preheat or partially fuse the lower unfused toner image 482 on the lower surface 34 to prevent disruption of the image in the nip of the first fuser 10. It may also be desirable to preheat or partially fuse the upper unfused toner image 40 on the upper surface 32 to provide a substantially similar state of the upper and lower toner images for the first and second fuser. Accordingly, in an example embodiment, fuser 510 optionally includes one or both of first and second blanket fusers 515 and 517 operably coupled to controller 96 and in operable communication with lower and upper substrate surfaces 34 and 32. First and second blanket fusers 515 and 517 are adapted to partially blanket fuse ("pre-fuse") unfused toner images 482 and/or 42, respectively to preserve the image integrity prior to the downstream addressable fusing stage carried out by fusers 10. The pre-fusing (e.g., pressure and/or heat) provided by first and second blanket fusers 515 and 517 depends on the nature of the unfused toner images and in an example embodiment is determined empirically. In another example embodiment, first and second blanket fusers 515 and 517 optionally provide for sub-threshold bias heating of respective substrate surfaces 34 and/or 32, i.e., heating below the fusing point temperature $T_{FP}$ of the unfused toner. Sub-bias threshold heating is described in greater detail below.

In the embodiments involving two toner images 42 and 482 on opposite surfaces 32 and 34 of substrate 30, the two toner images can be considered as first and second portions of a single toner image. Also, in an example embodiment, substrate cleaning is be performed either between the fusers or just after the second fuser.

Sensor Feedback for Heating Control

The amount of heat provided to the substrate by the one or more addressable arrays (e.g., array 50, array 450 and others, if necessary) is controlled by the amount of heat (e.g., the intensity of the optical radiation) from each addressable heating element. In a typical situation where fuser 10 is operated over a significant period of time, it achieves a slowly varying steady-state temperature that is determined by the average amount of heat generated in the fuser, including any optional sub-threshold bias heating, as described below.

As heating requirements tend to vary as a function of the different printed images, the fuser will often be in transition between different steady states. Nevertheless, it is desirable to maintain a substantially constant fusing temperature at the fusing point of the toner, i.e., at or near nip 20 (FIG. 2).

Figure 11:
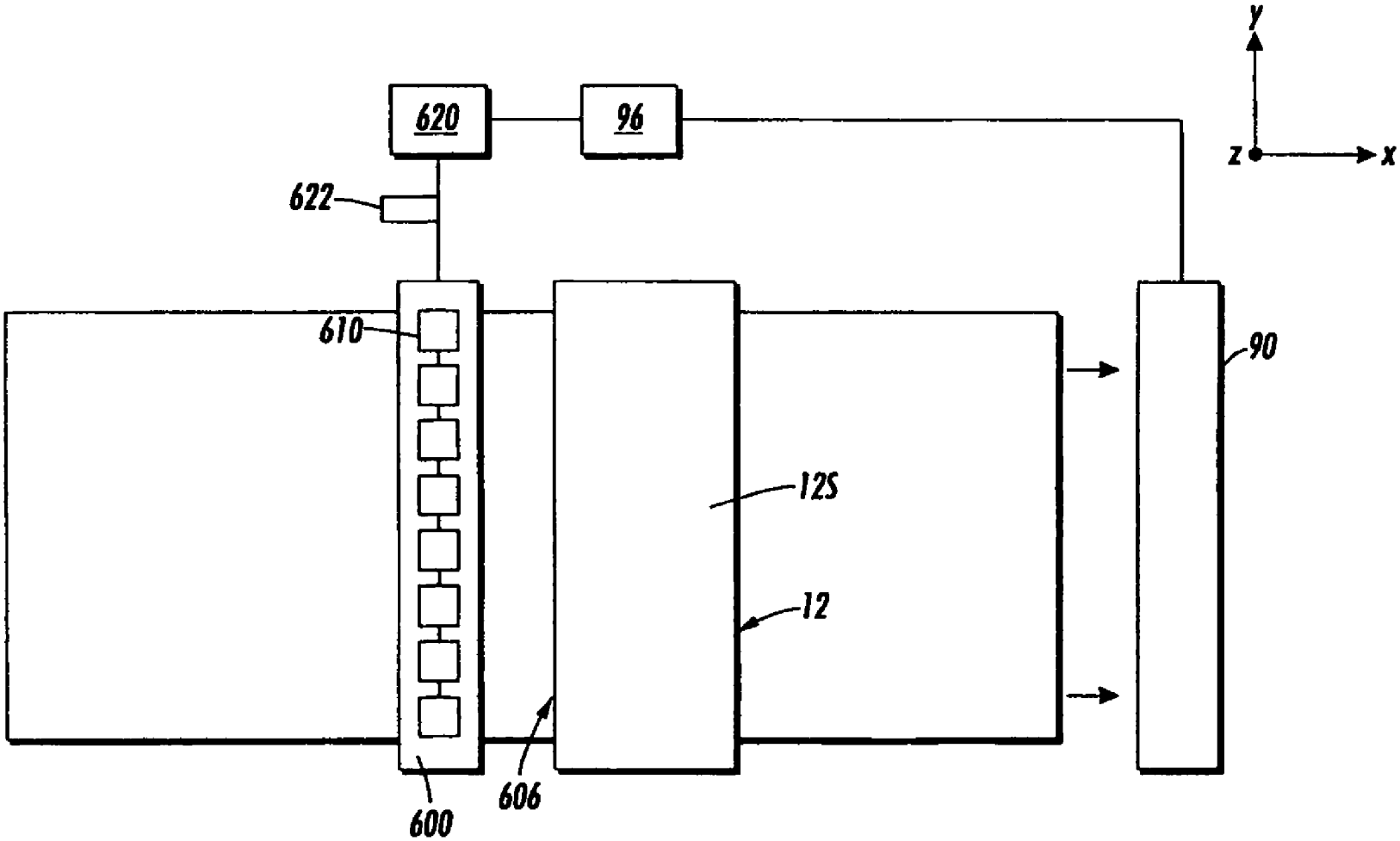
FIG. 11 is a close-up, simplified plan view of the printer of FIG. 1, emphasizing the temperature sensor unit arranged to measure the temperature of a portion of the fuser.

FIG. 11 is a close-up plan view of the fuser 10 of printer 6 as shown in FIG. 1, and further including a temperature sensor unit 600 arranged adjacent fuser roll 12. Temperature sensor unit 600 is adapted to measure the temperature of a portion of fuser 10. In an example embodiment, temperature sensor unit 600 is arranged and adapted to measure the temperature of a portion 606 of fuser roll surface 12S adjacent nip 20 (FIG. 2).

Temperature sensor unit 620 is operably (e.g., electrically) coupled to controller 96. In an example embodiment, temperature sensor unit includes an array of temperature sensors 610 corresponding, for example, directly or proportionately to heating elements 52 in array 50. In an example embodiment where temperature sensor unit 600 is an analog device, an analog-to-digital (A/D) converter 620 is provided between the temperature sensor unit and controller 96 so that the controller receives a digital signal. Temperature sensor unit 600 could include contact temperature sensors like thermistors, thermopiles, thermocouples or non-contact temperature sensors, all of which are well-known to those skilled in the art.

With continuing reference to FIG. 11, in the operation of fuser 10 shown therein, temperature sensor unit 600 measures the temperature of portion 606 of fuser roll surface 12S and provides to controller 96 a temperature signal 622 that corresponds to the measured temperature. Based on temperature signal 622, controller 96 directs driver 76 to activate addressable heating elements 52 to provide a select amount of heat. In an example embodiment, the select amount of heat provided is such that unfused toner 40 is fused to substrate upper surface 32 at or very close to the fusing point temperature $T_{FP}$ of the toner.

If temperature sensor unit 600 measures a temperature at fuser roll portion 606 that approaches the fusing point temperature and generates a corresponding temperature signal 622, then in an example embodiment, controller 96 responds by shutting down the operation of fuser 10 until it cools down to an acceptable fuser roll temperature to avoid blanket fusing the entire substrate. In another example embodiment, cleaning unit 90 includes a vacuum or air stream (not shown) that is activated by controller 96 to remove heat from the vicinity of the fuser roll in order to reduce its temperature or to otherwise keep the temperature of fuser 10 well below the fusing point temperature $T_{FP}$.

Sub-Threshold Bias Heating

Figure 12:
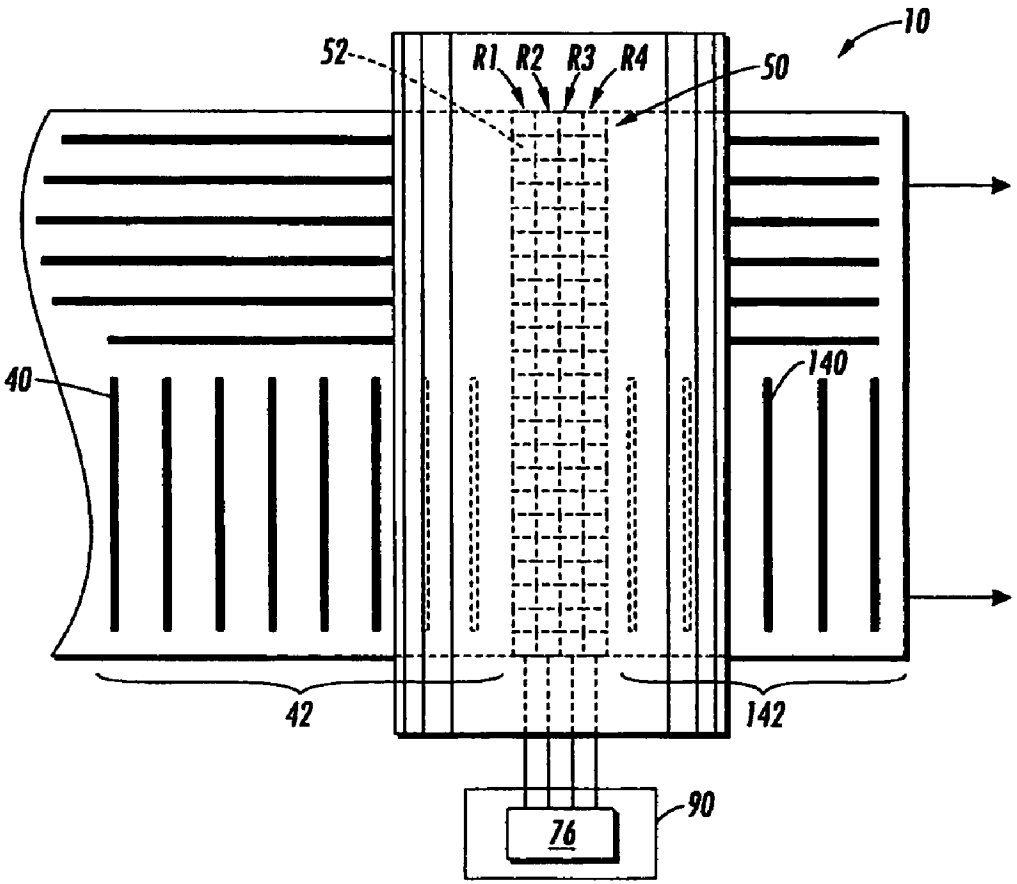
FIG. 12 is a close-up plan view of an example embodiment of a fuser similar to that shown in FIG. 1, wherein the addressable array of heating elements is a 4×N array with rows R1-R4.

FIG. 12 is a close-up plan view of an example embodiment of fuser 10 similar to that shown in FIG. 1 as part of printer 6, wherein addressable array 50 is a 4×N array with rows R1-R4. Fuser 10 of FIG. 12 is adapted to carry out an example embodiment of the present invention that involves providing sub-threshold bias heating to the substrate along with addressable fusing or heating.

In the operation of fuser 10 of FIG. 12 for carrying out sub-bias threshold heating prior to addressable fusing or heating, controller 96 activates addressable heating elements 52 in rows R1-R3 while substrate 30 passes through nip 20. This serves to provide substrate upper surface 32 with a background heating level, which in an example embodiment raises the temperature to a background temperature TB that is below the threshold level that fixes the unfused toner 40, e.g., is below the fusing point temperature $T_{FP}$. Then, as substrate 30 proceeds through the nip, row R4 selectively heats those portions of substrate surface 32 covered with toner and that forms unfused toner image 42, as described above. In the present example embodiment, the amount of heat (e.g., optical radiation 61) needed to be provided by addressable heating elements 52 in row R4 is only that needed to raise the temperature of the unfused toner image 42 from the background temperature TB to be at or beyond the fusing point temperature $T_{FP}$ to form fused image 142.

In another example embodiment, the selective heating applied by heating elements 52 is not based on unfused toner image 42, but rather is selected to heat portions of the substrate for a purpose other than toner fixing, such as changing the finish of substrate surface 32, as described above.

Gloss Control

As mentioned above, substrate 30 can have different types of surface finish, e.g., matte or gloss. Likewise, fused toner 140 can also have a like surface finish or appearance. In certain instances, unfused toner image 42 can include both low-pile and high-pile portions, which when fused can have a different appearance. The pile height can be determined from the electronic image, and the amount of gloss corresponds to the pile height.

Thus, with continuing reference to FIG. 12, in an example embodiment this information is used to control the gloss of the fused toner image 42 by the application of select amounts of heat from the heating elements 52 in array 50. In a particular example embodiment, heating elements in rows R1-R3 provide sufficient heat for unfused toner 40 to reach fusing point temperature $T_{FP}$ while heating elements in row R4 enhance the gloss of fused toner image 142.

In another example embodiment, addressable heating elements 52 are used to make the gloss in fused toner image 142 non-uniform, thereby achieving a differential gloss effect.

Multiple-Row Addressability

With continuing reference to FIG. 12, in an example embodiment, two or more rows of addressable heating elements (e.g., rows R1-R4) are used to selectively apply heat to substrate surface 32 much in the same manner as described above in connection with fuser 10 as seen in FIG. 1, wherein array 50 had a single row of addressable elements. This more generalized embodiment allows greater throughput of substrates through the fuser by providing a greater amount of heat to each portion of the substrate to be fused through the use of multiple-row selective irradiation. Alternatively, the same throughput as a single-row array can be achieved with less heat being generated by each addressable element.

Shifted Rows for Higher Resolution

Figure 13:
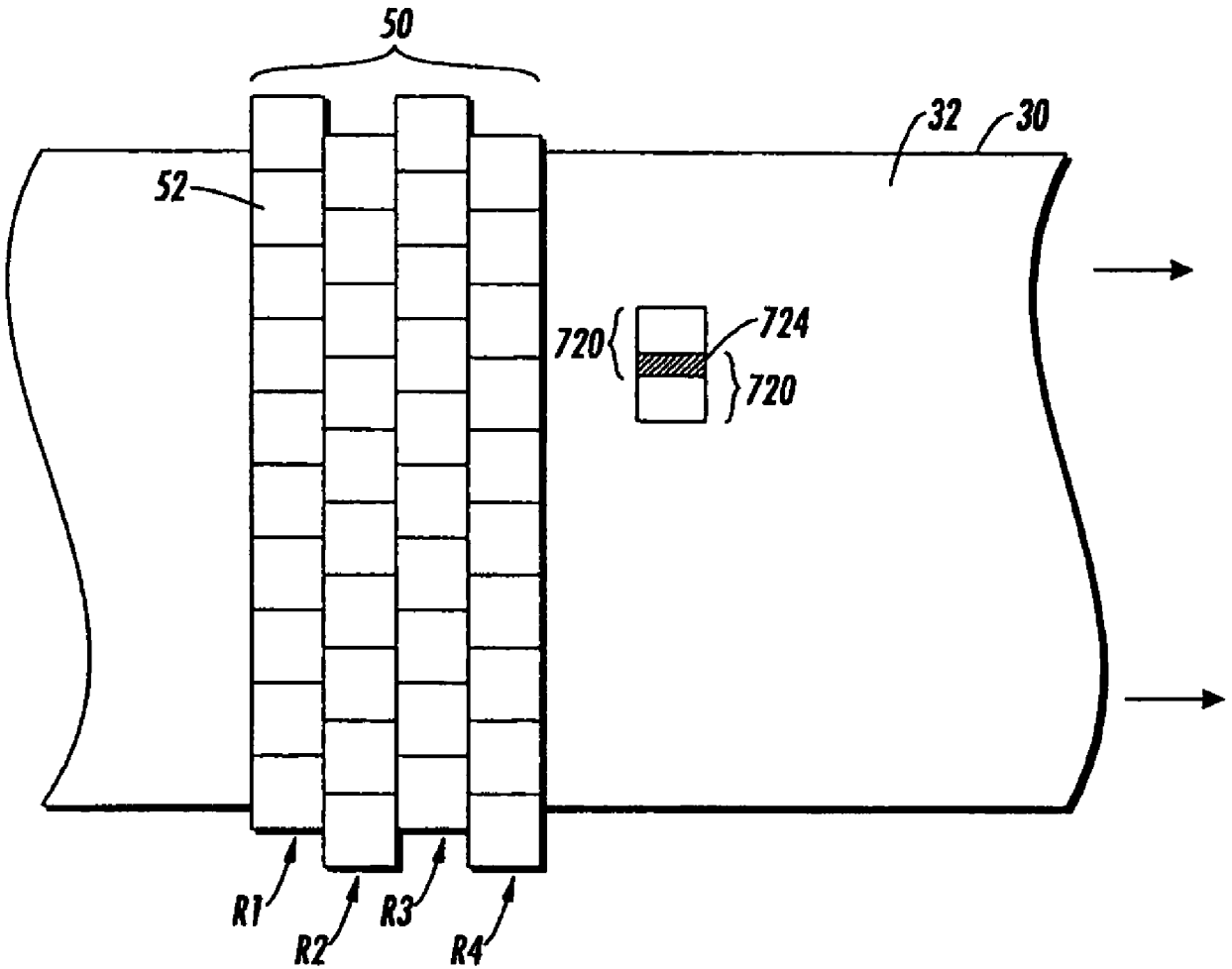
FIG. 13 is a plan view of an example embodiment of the array of addressable heating elements in which adjacent rows of addressable heating elements are shifted relative to one another in order to enhance the heating resolution of the array at the substrate.

FIG. 13 is a plan view of an example embodiment of array 50 in which adjacent rows of addressable heating elements are shifted relative to one another, e.g., by half the width of a heating element. This arrangement allows for a higher resolution in heating area to be obtained by overlapping the irradiated areas of adjacent shifted elements and providing an amount of power to each element such that the overlapped irradiated areas have sufficient heat to process the substrate, e.g., fuse an unfused toner image 42 to create a fused toner image 142. This is illustrated in FIG. 13, wherein two heating areas 720 (e.g., heat images) formed by addressable elements 52 from adjacent rows are partially overlapped to form a smaller heating area 724 with twice the heat of the two overlapping heating areas.

Thus, whereas each row in array 50 includes on the order of ten heating elements 52 per inch, the number of effective heating elements becomes 40 per inch if four rows R1-R4 are offset relative to each adjacent row. Gaps that are present between the overlapped irradiated areas 324 formed by adjacent addressable elements are smoothed out by the action of fuser roll 12, which serves to blend the irradiated areas at substrate surface 32. Offsetting adjacent rows by more than one LED spacing allows for compensating isolated single-LED defects.

In the foregoing Detailed Description, various features are grouped together in various example embodiments for ease of understanding. The many features and advantages of the present invention are apparent from the detailed specification, and, thus, it is intended by the appended claims to cover all such features and advantages of the described apparatus that follow the true spirit and scope of the invention. Furthermore, since numerous modifications and changes will readily occur to those of skill in the art, it is not desired to limit the invention to the exact construction, operation and example embodiments described herein. Accordingly, other embodiments are within the scope of the appended claims.

What is claimed is:

1. A fuser apparatus for selectively heating the surface of a substrate including an unfused toner image, comprising:

an electronic image storage device to store electronic image information about the unfused toner image;

an array of individually addressable heating elements in radiative communication with the substrate; and a programmable driver operably coupled to the array of individually addressable heating elements and to the electronic image storage device: the programmable driver operative to receive the electronic image information from the electronic image storage device relating to the unfused toner image and to activate the individually addressable heating elements selectively based upon the electronic image information about the unfused toner image to heat substantially only an area of the substrate covered by the unfused toner image as the substrate moves past the array.

2. The apparatus of claim 1, further including a hollow fuser roll in operable contact with the substrate, wherein the array is arranged within an interior of the fuser roll so as to be in radiative communication with the substrate through the fuser roll.

3. The apparatus of claim 1, further including a fuser belt that maintains operable contact with the substrate, and wherein the array is in radiative communication with the substrate through the fuser belt.

4. The apparatus of claim 3, wherein the fuser belt is stored on a source roll, is collected by a take-up roll, and runs around an outside portion of a fuser roll operably arranged between the source and take-up rolls, and wherein the array is arranged to be in radiative communication with the substrate through the fuser belt and the fuser roll.

5. The apparatus of claim 1, wherein the array of individually addressable heating elements is one selected from the group of heating element arrays comprising: a light-emitting diode (LED) array, a vertical-cavity surface-emitting laser (VCSEL) array, an edge-emitting laser diode, and a liquid crystal pixel illuminated by a line illuminator.

6. The apparatus of claim 1, further including: a pressure roll arranged opposite a fuser roll so as to form a nip through which the substrate travels past the array, the fuser roll having an interior in which the array is arranged so as to be in radiative communication with the substrate through the fuser roll.

7. The apparatus of claim 1, further including focusing optics arranged between the array and the substrate, the focusing optics adapted to focus heating energy from the array onto a surface of the substrate.

8. The apparatus of claim 1, wherein the array of individually addressable heating elements includes a single row of addressable heating elements.

9. The apparatus of claim 1, wherein each individually addressable heating element forms an associated heating area at the substrate surface, and wherein the addressable elements are arranged in two or more rows, with adjacent rows being offset relative to one another so as to provide partially overlapping heating areas at the substrate surface.

10. The apparatus of claim 1, wherein the programmable driver is adapted to cause each of the individually addressable heating elements to generate a variable controlled amount of heat based upon the electronic image information to selectively control an amount of gloss in a fused toner image formed from the unfused toner image.

11. The apparatus of claim 1, wherein the programmable driver is adapted to cause each of the individually addressable heating elements to generate a controlled amount of heat.

12. The apparatus of claim 1, further comprising a blanket fuser arranged upstream of the array of individually addressable heating elements and in operable communication with the substrate surface so as to partially fuse the unfused toner image prior to being heated by said array of addressable heating elements.

13. The apparatus of claim 1, further comprising:

an image sensor configured to capture an electronic image of the unfused toner image as second electronic image information;

wherein the programmable driver is configured to activate the individually addressable heating elements in response to the second electronic image information.

14. The apparatus of claim 1, further comprising:

a fuser roll including the array of individually addressable heating elements; and a plurality of temperature sensors, each temperature sensor configured to measure a temperature of a portion of the fuser roll;

wherein the programmable driver is configured to activate the individually addressable heating elements in response to the temperatures measured by the temperature sensors.

15. The apparatus of claim 1, wherein the individually addressable heating elements are disposed in a plurality of rows, each row including a plurality of the individually addressable heating elements.

16. The apparatus of claim 15, wherein the programmable driver is configured to activate the individually addressable heating elements such that:

the individually addressable heating elements of at least one of the rows raises a temperature of the surface of the substrate to substantially the same temperature below a fusing point temperature; and the individually addressable heating elements of at least one other row of the rows raises the temperature of the surface of the substrate to at least the fusing point temperature based on the electronic image information.

17. The apparatus of claim 15, wherein for a row of the rows of individually addressable heating elements, a location of the individually addressable heating elements of the row are shifted along a direction of the row relative to the individually addressable heating elements of another row.

18. A fuser apparatus for selectively heating a surface of a substrate including an unfused toner image on the surface, comprising:

an electronic image storage device to store electronic image information indicating positions of unfused toner of the unfused toner image on the substrate;

an array of individually addressable heating elements in radiative communication with the substrate; and a programmable driver operably coupled to the array of individually addressable heating elements and to the electronic image storage device: the programmable driver operative to receive the electronic image information from the electronic image storage device relating to the unfused toner image and to activate the individually addressable heating elements selectively based upon the positions of the unfused toner of the unfused toner image on the substrate as the substrate moves past the array.

* * * * *